US006601030B2

(12) United States Patent
Syrdal

(10) Patent No.: US 6,601,030 B2
(45) **Date of Patent: *Jul. 29, 2003**

(54) METHOD AND SYSTEM FOR RECORDED WORD CONCATENATION

(75) Inventor: Ann K. Syrdal, Morristown, NJ (US)

(73) Assignee: AT&T Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/198,105

(22) Filed: Nov. 23, 1998

(65) Prior Publication Data

US 2002/0069061 A1 Jun. 6, 2002

Related U.S. Application Data

(60) Provisional application No. 60/105,989, filed on Oct. 28, 1998.

(51) Int. Cl.[7] ..... G10L 13/00
(52) U.S. Cl. ..... 704/258; 704/260
(58) Field of Search ..... 704/258, 260, 704/257, 207, 209

(56) References Cited

U.S. PATENT DOCUMENTS 5,384,893 A * 1/1995 Hutchins ..... 704/258
5,500,919 A * 3/1996 Luther ..... 704/260
5,592,585 A * 1/1997 Coile et al. ..... 704/206
5,796,916 A * 8/1998 Meredith ..... 704/207
5,850,629 A * 12/1998 Holm et al. ..... 704/260
5,878,393 A * 3/1999 Hata et al. ..... 704/260
5,905,972 A * 5/1999 Huang et al. ..... 704/268
5,930,755 A * 7/1999 Cecys ..... 704/260
6,035,272 A * 3/2000 Nishimura et al. ..... 704/258

* cited by examiner

*Primary Examiner*—Daniel Abebe

(57) ABSTRACT

A method and system are provided for performing recorded word concatenation to create a natural sounding sequence of words, numbers, phrases, sounds, etc. for example. The method and system may include a tonal pattern identification unit that identifies tonal patterns, such as pitch accents, phrase accents and boundary tones, for utterances in a particular domain, such as telephone numbers, credit card numbers, the spelling of words, etc.; a script designer that designs a script for recording a string of words, numbers, sounds etc., based on an appropriate rhythm and pitch range in order to obtain natural prosody for utterances in the particular domain and with minimum coarticulation between concatenative units; a script recorder that records a speaker's utterances of the domain strings; a recording editor that edits the recorded strings by marking the beginning and end of each word, number etc. in the string and including or inserting pauses according to the tonal patterns; and a concatenation unit that concatenates the edited recording into a smooth and natural sounding string of words, numbers, letters of the alphabet, etc., for audio output.

13 Claims, 3 Drawing Sheets

*FIG. 3*

| | |
|---|---|
| SPOKEN TELEPHONE NUMBER: | 1 2 (3) 4 5 (6) 7 8 9 (0) |
| PITCH ACCENTS: | H* H* H* H* H* H* H* H* H* H* |
| PHRASE ACCENTS AND BOUNDARY TONES: | L-H% L-H% L-L% |

*FIG. 4*

| DIGIT | TONAL PATTERN |
|---|---|
| 1 | H* |
| 2 | H* |
| 3 | H*L-H% |
| 4 | H* |
| 5 | H* |
| 6 | H*L-H% |
| 7 | H* |
| 8 | H* |
| 9 | H* |
| 0 | H*L-L% |

METHOD AND SYSTEM FOR RECORDED WORD CONCATENATION

This non-provisional application claims the benefit of U.S. Provisional Application No. 60/105,989, filed Oct. 28, 1998, the subject matter of which is incorporated herein by reference.

BACKGROUND OF THE INVENTION

1. Field of Invention

This invention relates to a method and system for recorded word concatenation designed to build a natural-sounding utterance.

2. Description of Related Art

Many speech synthesis methods and systems in existence today produce a string of words or sounds that, when placed in the normal context of speech, sound awkward and unnatural. This unnaturalness in speech is evident when speech synthesis techniques are applied to such areas as providing telephone numbers, credit card numbers, currency figures, etc. These conventional methods and systems fail to consider basic prosodic patterns of naturally spoken utterances based on acoustic information, such as timing and fundamental frequency.

SUMMARY OF THE INVENTION

A method and system are provided for performing recorded word concatenation to create a natural sounding sequence of words, numbers, phrases, sounds, etc. for example. The method and system may include a tonal pattern identification unit that identifies tonal patterns, such as pitch accents, phrase accents and boundary tones, for utterances in a particular domain, such as telephone numbers, credit card numbers, the spelling of words, etc.; a script designer that designs a script for recording a string of words, numbers, sounds, etc., based on an appropriate rhythm and pitch range in order to obtain natural prosody for utterances in the particular domain and with minimum coarticulation so that extracted units can be recombined in other contexts and still sound natural; a script recorder that records a speaker's utterances of the scripted domain strings; a recording editor that edits the recorded strings by marking the beginning and end of each word, number etc. in the string and including silences and pauses according to the tonal patterns; and a concatenation unit that concatenates the edited recording into a smooth and natural sounding string of words, numbers, letters of the alphabet, etc., for audio output.

These and other features and advantages of this invention are described in or are apparent from the following detailed description of the preferred embodiments.

BRIEF DESCRIPTION OF THE DRAWINGS

The invention is described in detailed with reference to the following drawings, wherein like numerals represent like elements, and wherein:

FIG. 3 is a diagram illustrating the prosodic slots in a telephone number example, and their associated tonal patterns;

FIG. 4 is a diagram of the tonal patterns for each of the telephone number slots in FIG. 3.

DETAILED DESCRIPTION OF PREFERRED EMBODIMENTS

Figure 1:
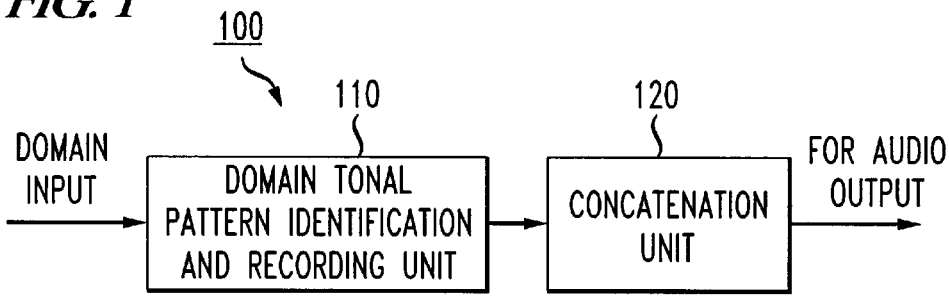
FIG. 1 is a block diagram of an exemplary recorded word concatenation system.

FIG. 1 is a basic-level block diagram of an exemplary recorded word concatenation system 100. The recorded word concatenation system 100 may include a domain tonal pattern identification and recording unit 110 connected to a concatenation unit 120. The domain tonal pattern identification and recording unit 110 receives a domain input, such as telephone numbers, credit card numbers, currency figures, word spelling, etc., and identifies the proper tonal patterns for natural speech and records scripted utterances containing those tonal patterns. The recorded patterns are then input into the concatenation unit 120 so the sounds may be joined together to produce a natural sounding string for audio output.

The functions of the domain tonal pattern identification and recording unit 110 may be partially or totally performed manually, or may be partially or totally automated, by using any currently known or future developed, processing and/or recording device, for example. The functions of the concatenation unit 120 may be performed by any currently known or future developed processing device, such as any speech synthesizer, processor, or other device for producing an appropriate audio output according to the invention. Furthermore, it may be appreciated that while the exemplary embodiment concerns recorded "word" concatenation, any language unit or sound, or part thereof, may be concatenated, such as numbers, letters, symbols, phonemes, etc.

Figure 2:
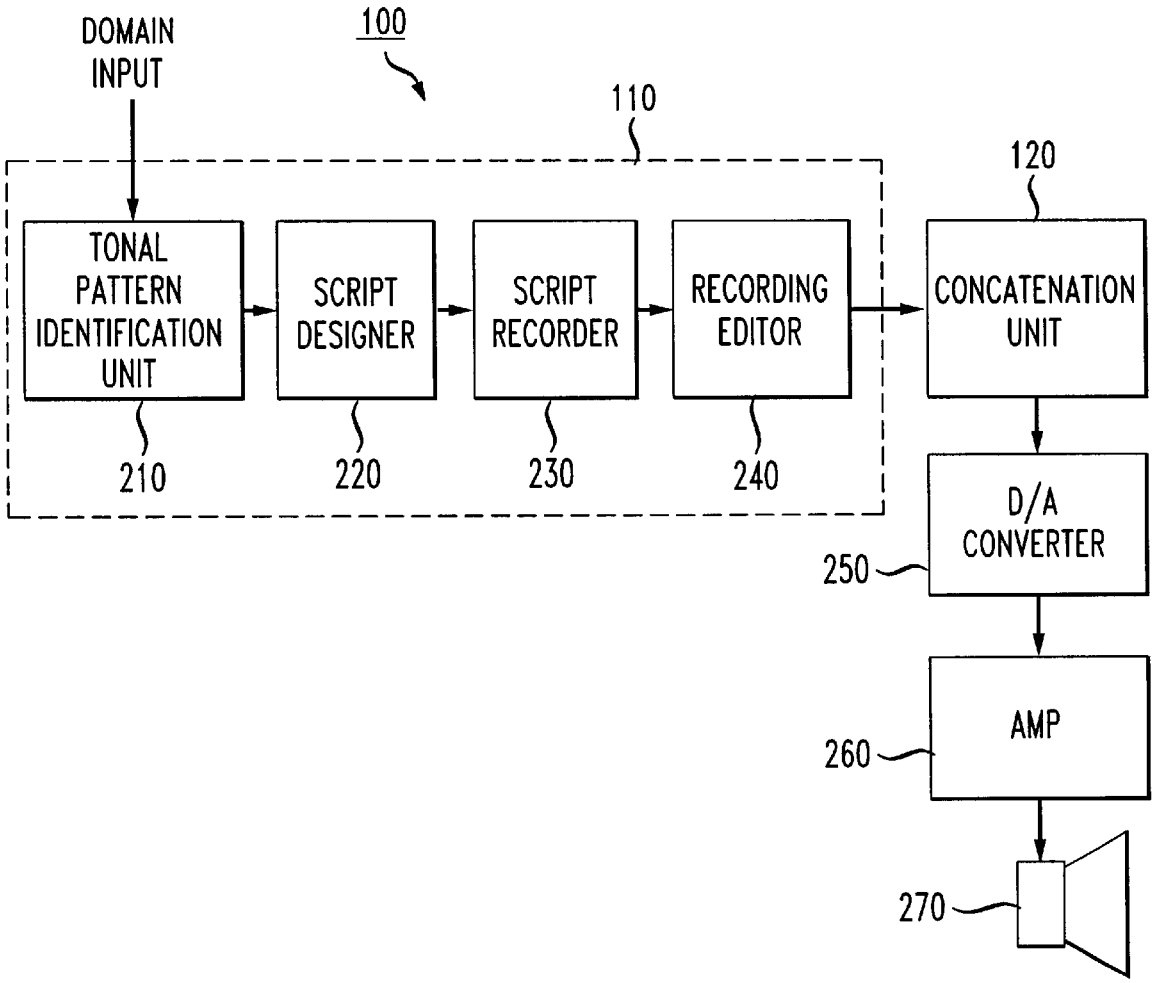
FIG. 2 is a more detailed block diagram of an exemplary recorded word concatenation system of FIG. 1.

FIG. 2 is a more detailed block diagram of an exemplary recorded word concatenation system 100 of FIG. 1. In the recorded word concatenation system 100, the domain tonal pattern identification and recording unit 110 may include a tonal pattern identification unit 210, a script designer 220, a script recorder 230, and a recording editor 240. The domain tonal pattern identification and recording unit 110 is connected to the concatenation unit 120 which is in turn, coupled to a digital-to-analog converter 250, an amplifier 260, and a speaker 270.

The tonal pattern identification unit 210 receives a tonal pattern input for a particular domain, such as telephone numbers, currency amounts, letters for spelling, credit card numbers, etc. In the following example, the domain-specific tonal patterns for telephone numbers are used. However, this invention may be applied to countless other domains where specific tonal patterns may be identified, such as those listed above. Furthermore, while a domain-specific example is used, it can be appreciated that this invention may be applied to non-domain-specific examples.

After the tonal pattern identification unit 210 receives the domain input for telephone numbers for example, the tonal pattern identification unit 210 determines various tonal patterns needed for each prosodic slot, such as the ten slots for each number in a telephone number string. For example, FIG. 3 illustrates the identification process in regard to a ten digit telephone number. This example uses the Tones and Break Index (ToBI) transcription system which is a standard system for describing and labeling prosodic events. In the ToBI system, "L*" represents a low-star pitch accent, "H* represents a high-star pitch accent, "L–" and "H–" represent low and high phrase accents, and "L %" and "H %" represent low and high boundary tones, respectively.

As shown in FIGS. 3 and 4, each digit in the 10 digit string is marked by one of three tonal patterns. The 1, 2, 4, 5, 7, 8, and 9 prosodic slots have only a high or "H*" pitch accent. However, while prosodic slots 3, 6 and 0 also have a high or "H*" pitch accent, prosodic slots 3, 6 and 0 have tonal patterns with phrase accents and boundary tones that differentiate them from the other 7 prosodic slots. For example, prosodic slots 3 and 6 have tonal patterns with a high pitch accent, low phrase accent, and high boundary tone, or "H*L–H %", and prosodic slot 0 has a tonal pattern with a high pitch accent, low phrase accent, and low boundary tone, or "H*L–L %".

Accordingly, three tonal patterns are needed for each of the ten digits (0–9) to synthesize any telephone number or any digit strings spoken in this prosodic style. It can be appreciated, that any other patterned order number sequence can have prosodic slots identified which represent different pitch accents, phrase accents and boundary tones for any words, numbers, etc. in the domain-specific string.

Once the tonal patterns are identified, they are input into a script designer 220. The script designer 220 designs a string that requires an appropriate pitch range for the tonal pattern, an appropriate rhythm or cadence for the connected digit strings, and minimal coarticulation of target digits so they can sound appropriate when extracted and recombined in different contexts.

In a first example which will be referred to below, the script for digit 1 with only pitch accent "H*" and digit 8 with the tonal pattern "H*L–L %", could read for example, 672-1288. A second example of a script for digit 0 with "H*L–H %" and digit 9 with "H*L–L %" could read 380–1489. For concatenated digits only target digits (underlined) are extracted and recombined whenever a digit with its tonal pattern is required.

Recorded digits spoken in a string like a telephone number gives the appropriate rhythm, constrains the pitch range, and yields natural prosody (durations, energy and tonal patterns). Designing the script to approximate the same place of articulation of the first phoneme of the target digit with the last phoneme of the proceeding digit (e.g., /u$^{w}$/-/w/ in the sequence 2-1 of the first example above), and of the last phoneme of the target digit with the first phoneme of the following digit (e.g., /n/-/t/ in the sequence 1-2 of the first example above) reduces mismatches of coarticulation when the target digits are extracted and recombined.

Once the script is designed, it is input to the script recorder 230 that records the script of spoken digit strings. In the script recorder 230, a speaker is asked to speak the strings naturally but clearly and carefully and the strings are recorded. In fact, multiple repetitions of each string in the script may be recorded.

The recorded script is then input into the recording editor 240. The recording editor 240 marks and onset and offset of each target digit often including some preceding or following silence. For example, for "H*" and "H*L–L %" tonal pattern targets, from 0–50 milliseconds of relative silence for preceding and following the digit may be included with the digit, and for "H*L–H %" targets, any or all of the silence in the pause following the digit may also be included with the digit. The proceeding and following silences are included to provide appropriate rhythm to the synthesized utterances (i.e., telephone numbers, letters of the alphabet, etc).

The edited recordings are then input to the concatenation unit 120. The concatenation unit 120 synthesizes the telephone number (or other digit string, etc.), so that the required tonal pattern of each digit is determined by its position in the telephone number. As shown in FIG. 4, for example, the telephone number (123) 456–7890 requires the concatenation of the digits shown along with their corresponding tonal pattern. It is useful to include in the inventory several instances (2 or more) of each digit and tonal pattern, and to sample them without replacement during synthesis. This avoids the unnatural sounding exact duplication of the same sound in the string.

The concatenated string is then output to a digital-to-analog converter 250 which converts the digital string to an analog signal which is then input into amplifier 260. The amplifier 260 amplifies the signal for audio output by speaker 270.

Figure 5:
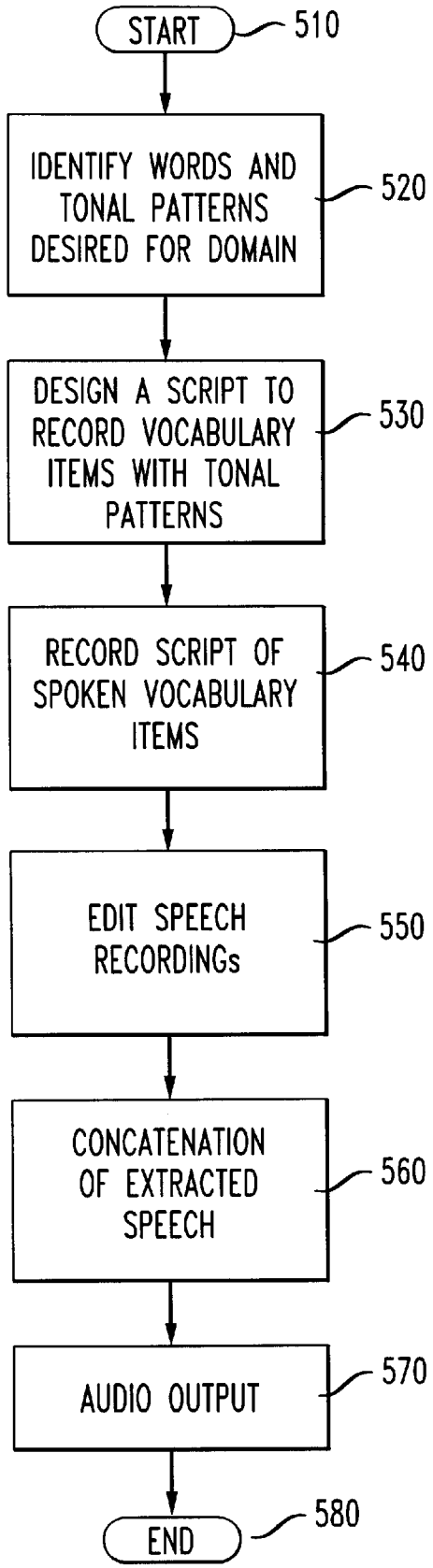
FIG. 5 is a flowchart of the recorded work concatenation process.

FIG. 5 is a flowchart of the recorded word concatenation system process. Process begins in step 510 and proceeds to step 520 where the tonal pattern identification unit 210 identifies words and tonal patterns desired for a specific domain. The process proceeds to step 530 where the script designer 220 designs a script to record vocabulary items with tonal patterns.

In step 540, the designed script is recorded by the script recorder 230 and output to the recording editor 240 in step 550. Once the recording is edited, it is output to the concatenation unit 120 in step 560 where the speech is concatenated and sent to the D/A converter 250, amplifier 260 and speaker 270 for audio output in step 570. The process then proceeds to step 580 and ends.

As indicated above, the recorded word concatenation system 100, or portions thereof, may be implemented in a program for general purpose computer. However, the recorded word concatenation system 100 may also be implemented on a special purpose computer, a programmed microprocessor or microcontroller and peripheral integrated circuit elements, and Application Specific Integrated Circuits (ASIC) or other integrated circuits, hardwired electronic or logic circuit, such as a discrete element circuit, a programmed logic device such as a PLD, PLA, FGPA, or PAL, or the like. Furthermore, portions of the recorded word concatenation process may be performed manually. Generally, however, any device with a finite state machine capable of performing the functions of the recorded word concatenation system 100, as described herein, can be implemented.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention.

What is claimed is:

1. A method of recording speech sounds used for synthesizing speech, the method comprising:

receiving information identifying a particular domain, the domain having unique prosody characteristics and rhythm;

identifying words and tonal patterns associated with the particular domain;

designing a word script related to the particular domain by applying the identified words and tonal patterns;

recording speaker utterances of the designed word script; and editing the recorded speaker utterances according to the particular domain tonal patterns.

2. The method of claim 1, wherein the identified tonal patterns relate at least to pitch accents.

3. The method of claim 2, wherein the identified tonal patterns relate at least to phrase accents.

4. The method of claim 3, wherein the identified tonal patterns relate at least to boundary tones.

5. The method of claim 1, wherein the particular domain relates to telephone numbers.

6. The method of claim 1, wherein the particular domain relates to spelling words.

7. The method of claim 1, wherein the particular domain relates to credit card numbers.

8. The method of claim 1, wherein the word script is designed to minimize coarticulation.

9. A method of synthesizing speech using speech units recorded from a script designed for a particular domain having an identifiable tonal pattern and rhythm, the script providing natural prosody for utterances in the particular domain and designed to minimize coarticulation, the recorded speech units being edited according to tonal patterns associated with the particular domain, the method comprising:

concatenating the edited recorded speech units into a string of words associated with the particular domain; and outputting the concatenated string of words as synthesized speech.

10. The method of claim 9, wherein the particular domain relates to telephone numbers.

11. The method of claim 9, wherein the particular domain relates to credit card numbers.

12. The method of claim 9, wherein the particular domain relates to spelling words.

13. A method of generating synthetic speech, the method comprising:

receiving information identifying a particular domain, the particular domain having unique prosody characteristics and rhythm;

identifying words and tonal patterns associated with the particular domain;

designing a word script related to the particular domain by applying the identified words and tonal patterns;

recording speaker utterances of the designed word script;

editing the recorded speaker utterances into speech units according to the particular domain tonal pattern, rhythm and natural prosody; and concatenating the speech units into a string of words as synthesized speech within the particular domain.

* * * * *